US008800072B2

(12) United States Patent
Chang

(10) Patent No.: US 8,800,072 B2
(45) Date of Patent: Aug. 12, 2014

(54) SHOWER CURTAIN ROD ASSEMBLY

(76) Inventor: Shih-Lin Chang, Tainan (TW)

( * ) Notice: Subject to any disclaimer, the term of this patent is extended or adjusted under 35 U.S.C. 154(b) by 344 days.

(21) Appl. No.: 13/446,225

(22) Filed: Apr. 13, 2012

(65) Prior Publication Data

US 2013/0269099 A1 Oct. 17, 2013

(51) Int. Cl.
*A47K 3/00* (2006.01)

(52) U.S. Cl.
USPC ..... 4/610; 4/558; 211/105.2; 211/119.009; 160/333

(58) Field of Classification Search
CPC ..... A47K 3/30; A47K 3/34; A47K 3/36; A47K 3/38; A47K 10/04; A47K 10/08; A47K 10/10; A47H 1/02; A47H 1/022; A47H 1/03; A47H 1/102; A47H 1/142; A47H 2001/0205
USPC ..... 4/558, 607–610; 248/251, 254, 262, 248/534, 264, 261, 265; 211/87.01, 96, 211/105.1, 105.2, 105.3, 119.001, 119.009, 211/123; 160/333
See application file for complete search history.

(56) References Cited

U.S. PATENT DOCUMENTS

| | | | | |
|---|---|---|---|---|
| 4,653,714 | A * | 3/1987 | Andrasko, Jr. | 248/251 |
| 6,364,264 | B1 * | 4/2002 | Lai | 248/251 |
| 6,845,955 | B1 * | 1/2005 | Hsu | 248/200.1 |
| 6,896,228 | B1 * | 5/2005 | Lu | 248/205.8 |
| 7,124,451 | B2 * | 10/2006 | Moore | 4/576.1 |
| 8,069,508 | B2 * | 12/2011 | O'Connell | 4/610 |
| 8,146,182 | B2 * | 4/2012 | Bauer | 4/558 |
| 8,166,583 | B1 * | 5/2012 | Liang | 4/610 |
| 8,205,760 | B2 * | 6/2012 | Chang | 211/105.3 |
| 8,214,501 | B1 * | 7/2012 | Peterson et al. | 709/227 |
| 8,505,749 | B2 * | 8/2013 | Trettin et al. | 211/105.2 |
| 2008/0295240 | A1 * | 12/2008 | Chang | 4/610 |
| 2011/0147326 | A1 * | 6/2011 | Woolley, II | 211/105.6 |

* cited by examiner

*Primary Examiner* — Huyen Le
*Assistant Examiner* — Erin Deery
(74) *Attorney, Agent, or Firm* — Muncy, Geissler, Olds & Lowe, P.C.

(57) ABSTRACT

A shower curtain rod assembly includes a suction disk, an engaging member, a positioning member, a cover and a rod unit. The shower curtain rod assembly is able to be installed between two walls with different inclinations and different distances.

7 Claims, 12 Drawing Sheets

SHOWER CURTAIN ROD ASSEMBLY

FIELD OF THE INVENTION

The present invention relates to a shower curtain rod assembly, and more particularly, to a shower curtain rod assembly that is adjustable regarding the distance between the two walls and the inclination of the walls.

BACKGROUND OF THE INVENTION

The conventional shower curtain rod disclosed in U.S. Pat. No. 6,216,287 issued on Apr. 17, 2001 is bulky and has certain length so that it is inconvenient for carry, storage and assembly. When one of the two walls is inclined relative to the other wall, the shower curtain rod cannot be properly installed.

Another conventional shower curtain rod disclosed in U.S. Pat. No. 7,958,577 issued on Jun. 14, 2011, and it can be adjusted within a very limited range and cannot be removed when needed. The walls are damaged when removed the shower curtain rod.

The present invention intends to provide a shower curtain rod assembly that improves the shortcomings of the conventional shower curtain rods.

SUMMARY OF THE INVENTION

The present invention relates to a shower curtain rod assembly and comprises a suction disk having a suction surface and a push rod is connected to the suction disk. The push rod has a hole and a pin extends through the hole. A resilient member is mounted to the push rod. An engaging member is connected to the suction disk and has a positioning portion. The positioning portion has a through hole and a first slot. Two pivotal portions are located on two sides of the positioning portion and each pivotal portion has a hole. A pivot extends through the holes of the pivotal portions. Each of the pivotal portions has a second slot which is located corresponding to the first slot. A restriction slot is defined in the engaging member. A positioning member is located on the engaging member and has a passage. Two inclined portions are located at the periphery of the passage and each inclined portion has a lowest point and a highest point. A first recess is defined in each of the lowest points and a second recess is defined in each of the highest points. A lever is located on the periphery of the positioning member. A protrusion extends from the underside of the positioning member and extends through the restriction slot. A cover is mounted to the engaging member and has an opening. A rod unit has a first section and a second section, wherein the first and second sections are movable relative to each other. The first section has a first pivotal end and a first connection end respectively on two ends thereof. The first pivotal end is pivotably connected to the pivotal portion of the engaging member. The second section has a second pivotal end and a second connection end respectively on two ends thereof. The second pivotal end is pivotably connected to the pivotal portion of the engaging member. The diameter of the second connection end is larger that of the first connection end. A gap is defined between the first and second connection ends when the second connection end is mounted to the first connection end. A slot is defined in the first connection end and a contact plate is located in the gap. The contact plate has uneven thickness which includes a maximum thickness which is equal to a width of the gap.

The shower curtain rod assembly of the present invention can be installed between two walls and the length of the rod assembly can be adjusted to the actual distance between the two walls.

The shower curtain rod assembly of the present invention can be installed between two walls of different inclinations and the rod unit can be rotated to meet the requirements between the two walls.

By using the suction disk, the shower curtain rod assembly of the present invention can be installed to and removed from the walls without damaging the walls.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
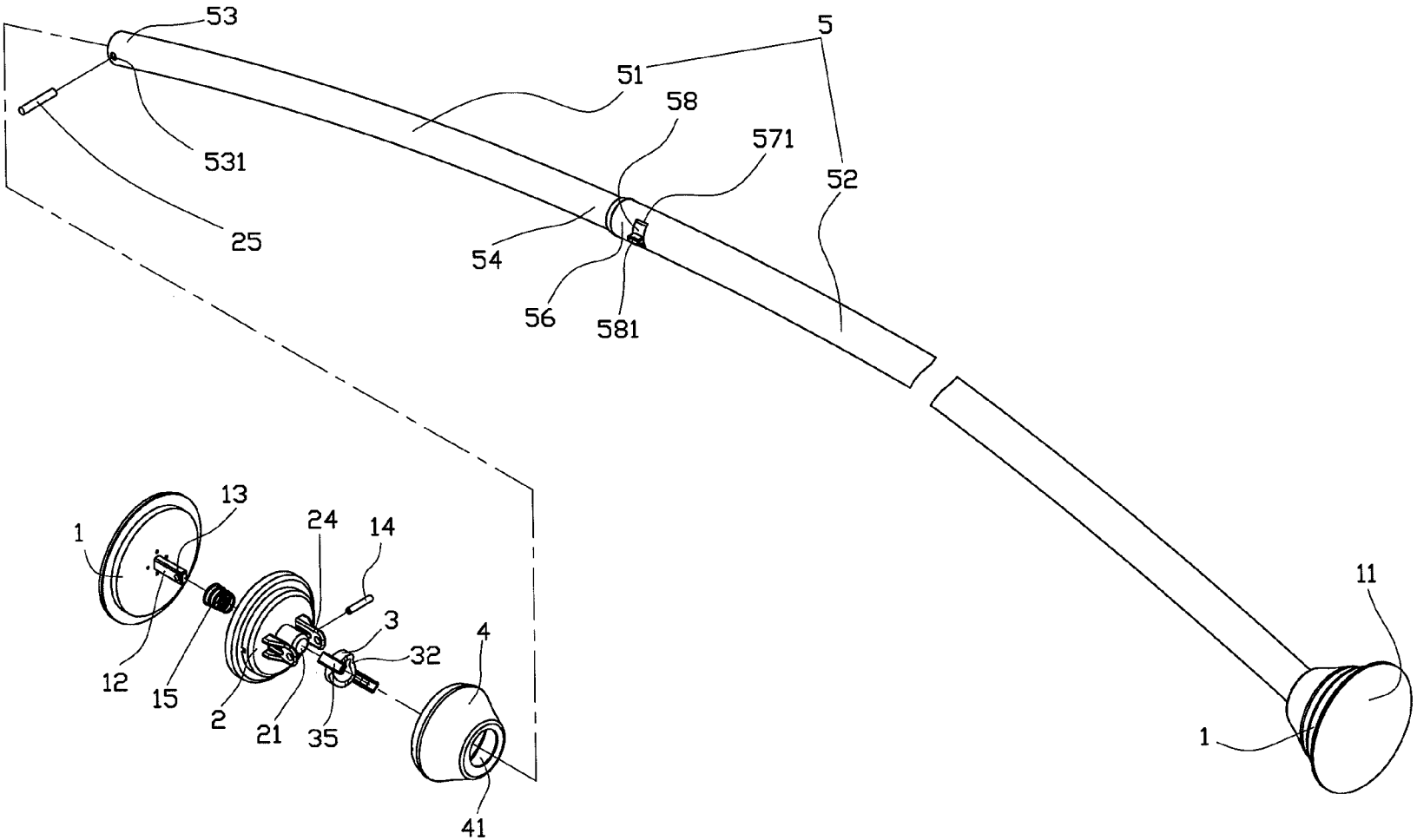
FIG. 1 is an exploded view to show the shower curtain rod assembly of the present invention.
Figure 2:
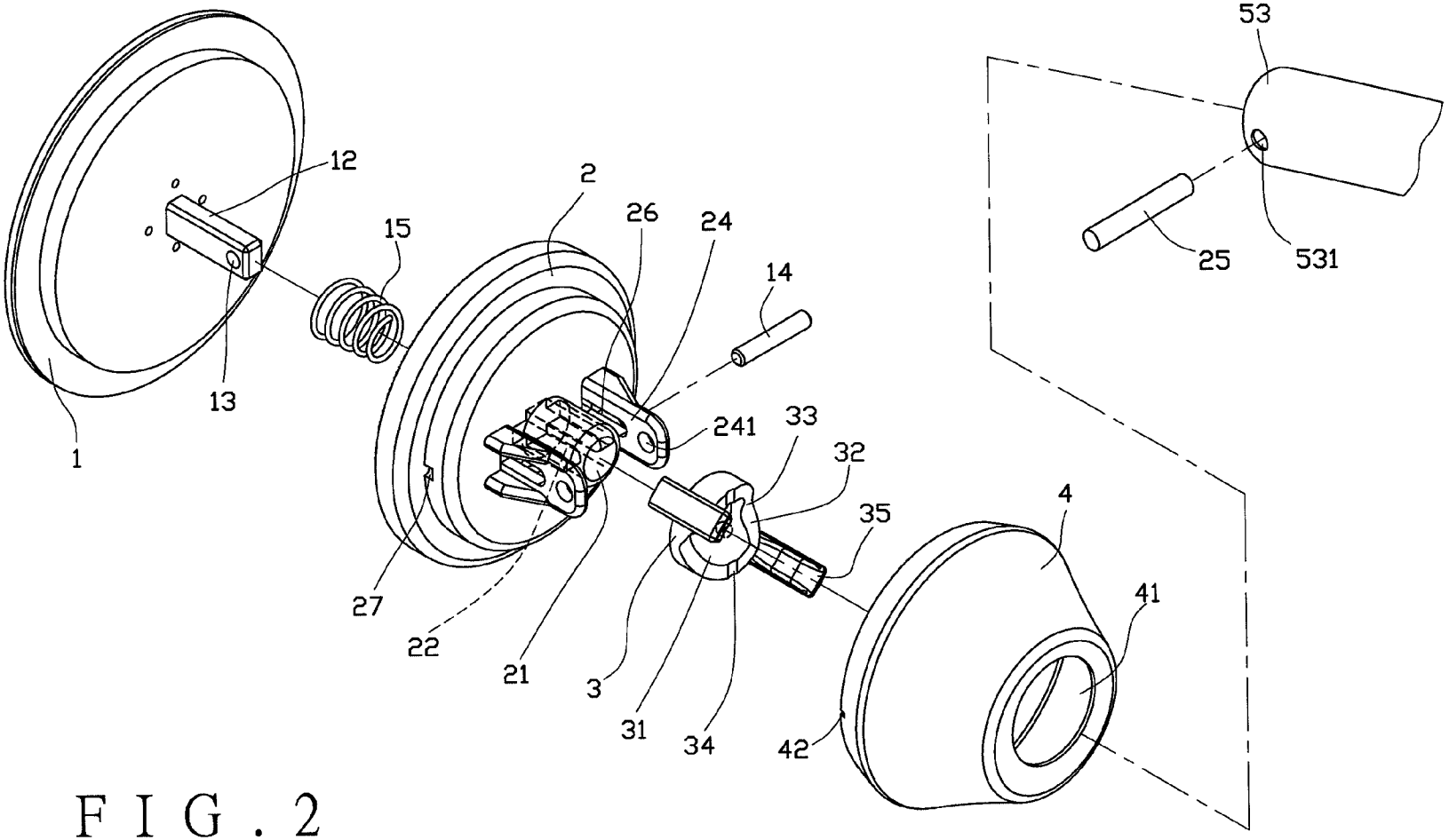
FIG. 2 is an exploded view to show the main parts of the shower curtain rod assembly of the present invention.
Figure 3:
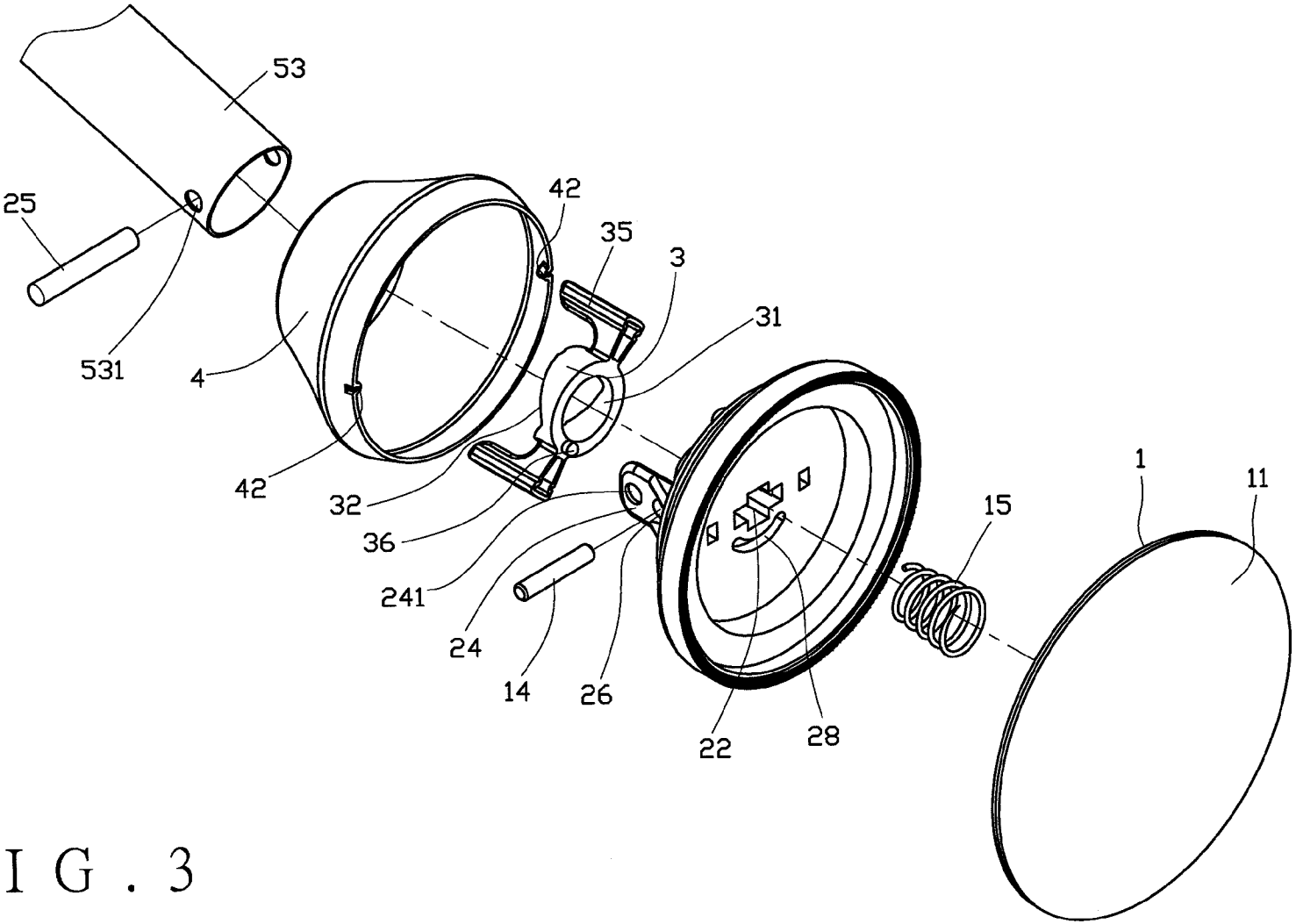
FIG. 3 is another exploded view to show the shower curtain rod assembly of the present invention.
Figure 4:
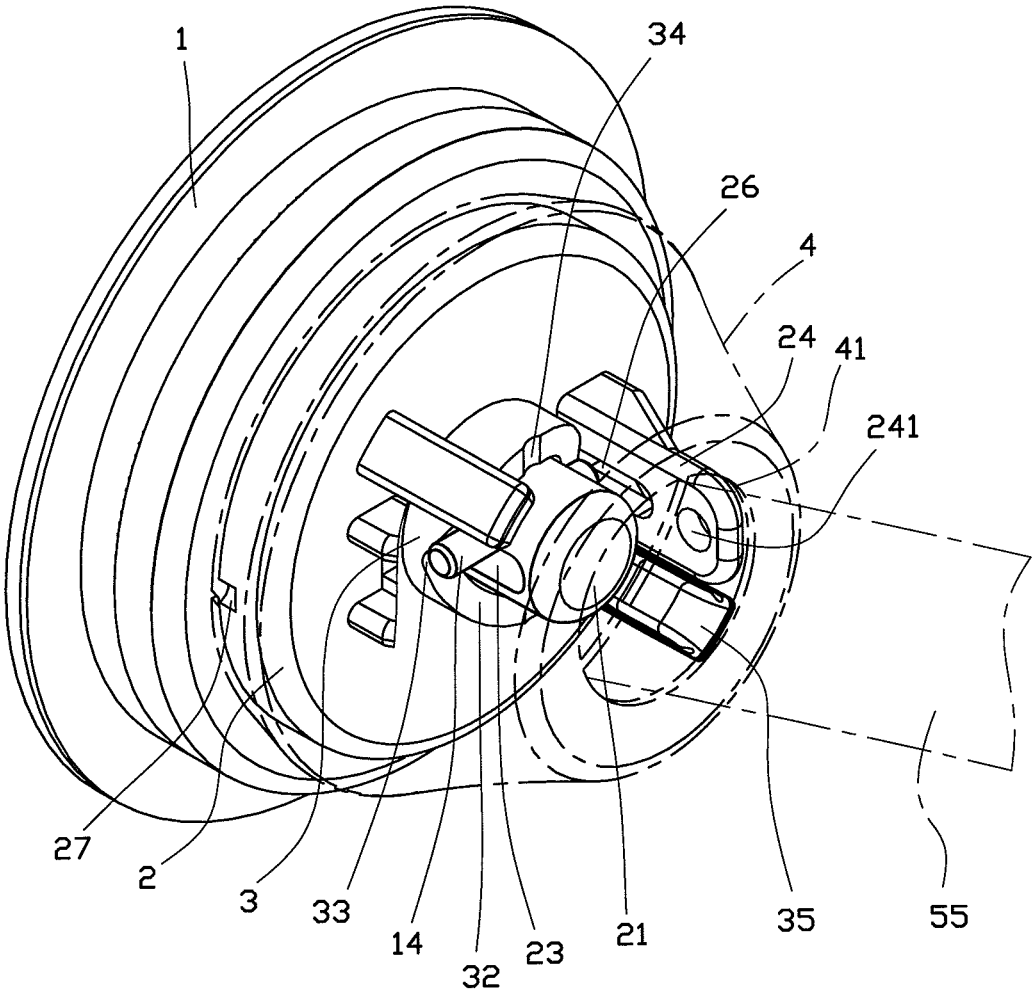
FIG. 4 is a perspective view to show the suction disk of the shower curtain rod assembly of the present invention.

Referring to FIGS. 1 to 4, the shower curtain rod assembly of the present invention comprises two suction disks 1, two engaging members 2, two positioning members 3, two covers 4 and a rod unit 5.

The suction disk 1 has a suction surface 11 and a push rod 12 is connected to the suction disk 1. The push rod 12 has a hole 13 and a pin 14 extends through the hole 13. A resilient member 15 is mounted to the push rod 12.

Figure 5:
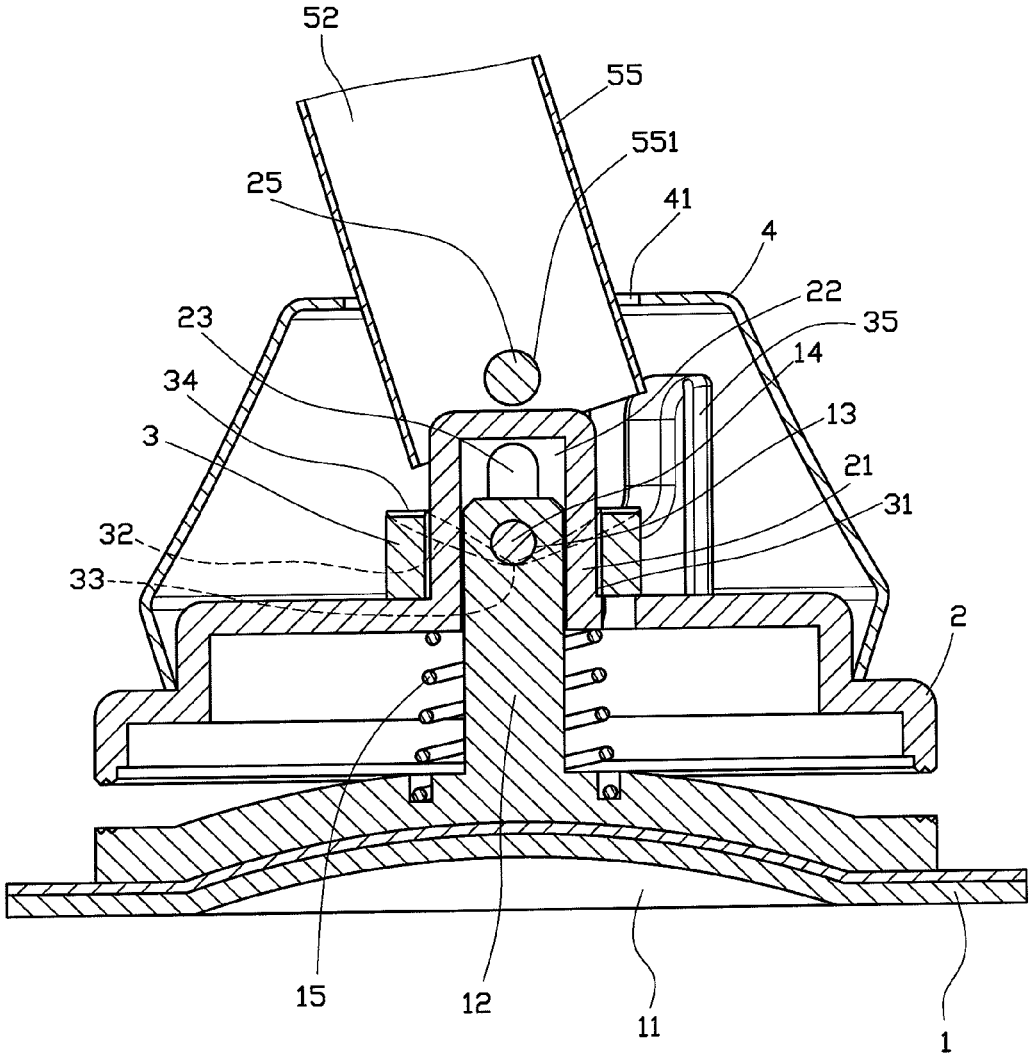
FIG. 5 is a cross sectional view of the suction disk of the shower curtain rod assembly of the present invention wherein the suction disk is not yet installed.
Figure 6:
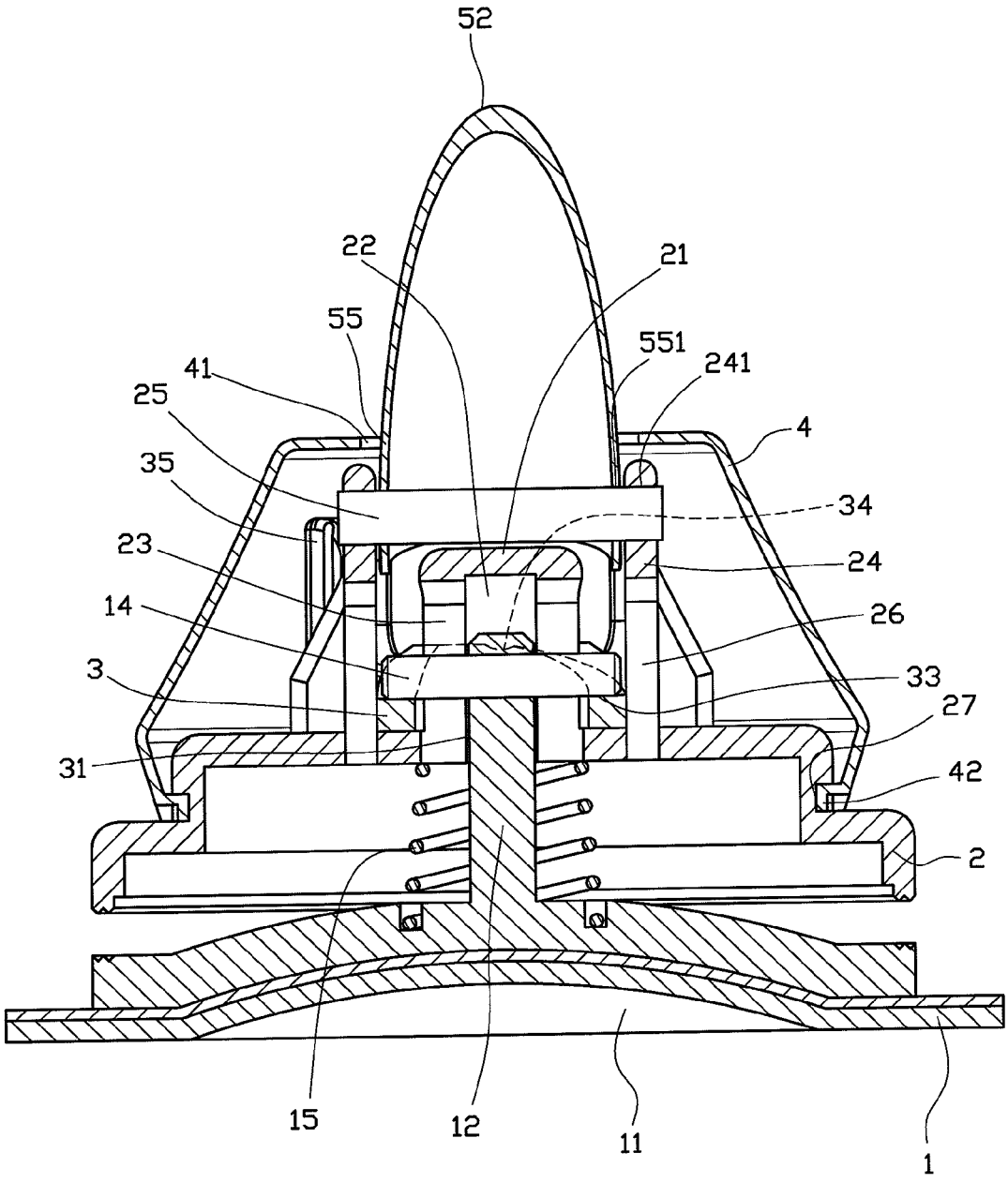
FIG. 6 is another cross sectional view of the suction disk of the shower curtain rod assembly of the present invention wherein the suction disk is not yet installed.

The engaging member 2 is connected to the suction disk 1 and has a positioning portion 21 which has a through hole 22 so that the push rod 12 extends through the through hole 22 and the resilient member 15 contacts the underside of the engaging member 2. A first slot 23 is defined transversely through the positioning portion 21 as shown in FIGS. 5 and 6. The pin 14 extends through the first slot 23. Two pivotal portions 24 are located on two sides of the positioning portion 21 and each pivotal portion 24 has a hole 241. A pivot 25 extends through the holes 241 of the pivotal portions 24. The pivotal portions 24 each have a second slot 26 which is located corresponding to the first slot 23. Two notches 27 are defined in the periphery of the engaging member 2. A curved restriction slot 28 is defined in the engaging member 2.

The positioning member 3 is located on the engaging member 2 and has a passage 31 through which the positioning portion 21 of the engaging member 2 extends therethrough. Two inclined portions 32 are located at the periphery of the passage 31 and two ends of the pin 14 contact the two inclined portions 32 respectively. The inclined portions 34 are located to form a V shape arrangement. Each inclined portion 32 has a lowest point and a highest point. A first recess 33 is defined in each of the lowest points and a second recess 34 is defined in each of the highest points. Two levers 35 are located on the periphery of the positioning member 3. A protrusion 36 extends from the underside of the positioning member 3 and movably extends within the restriction slot 28.

The cover 4 is mounted to the engaging member 2 and has an opening 41. The cover 4 has two blocks 42 on the periphery thereof and the blocks 42 are engaged with the two notches 27 so as to connect the cover 4 to the engaging member 2.

Figure 7:
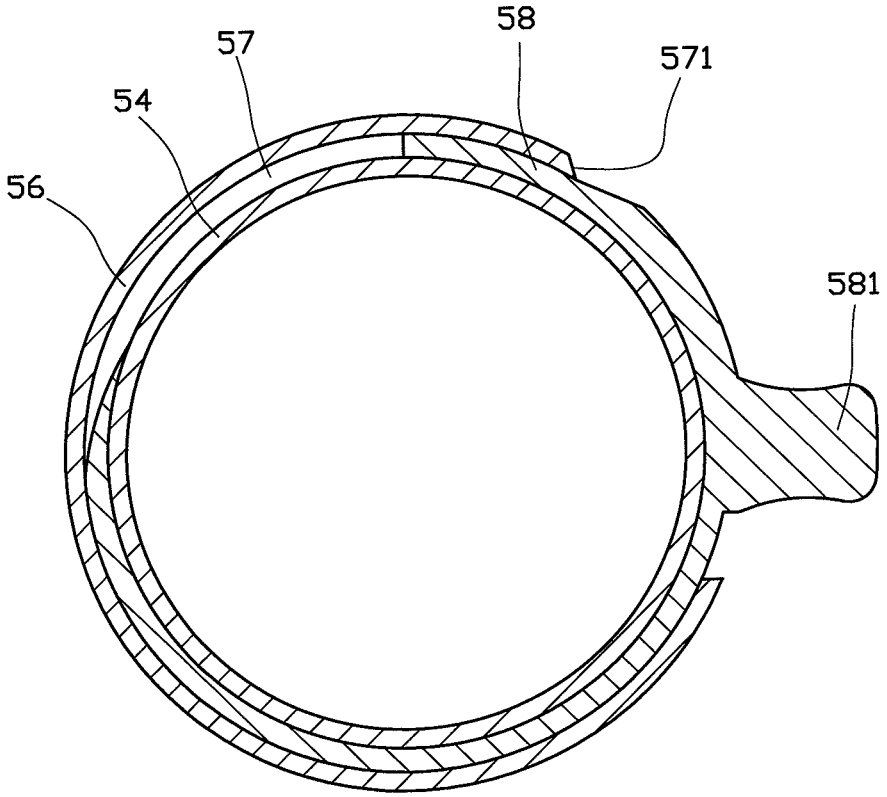
FIG. 7 is a cross sectional view of the rod unit of the shower curtain rod assembly of the present invention.

The rod unit 5 is pivotably connected to the pivotal portions 24 of the engaging member 2 and has a first section 51 and a second section 52, wherein the first and second sections 51, 52 are movable relative to each other. The first section 51 has a first pivotal end 53 on an end thereof and which has a first pivotal hole 531. The first pivotal end 53 extends into the opening 41 of the cover 4. The first pivotal end 53 is pivotably connected to the first pivotal hole 531 and the hole 241 of one of the pivotal members 24 by the pivot 25. The first section 51 has a first connection end 54 on the other end thereof as shown in FIG. 7. The second section 52 has a second pivotal end 55 on one end thereof and a second pivotal hole 551 is defined through the second pivotal end 55. The second pivotal end 55 extends into the opening 41 of the cover 4. The second pivotal end 55 is pivotably connected to the second pivotal hole 551 and the hole 241 of the other one of the pivotal members 24 by the pivot 25. Therefore, the rod unit 5 is pivotably connected between the two engaging members 2. The second section 52 has a second connection end 56 on the other end thereof. The diameter of the second connection end 56 is larger than that of the first connection end 54. A gap 57 is defined between the first and second connection ends 54, 56 when the second connection end 56 is mounted to the first connection end 54. A slot 571 is defined in the first connection end 54 and a contact plate 58 is located in the gap 57. The contact plate 58 has uneven thickness which includes a maximum thickness which is equal to a width of the gap 57. The contact plate 58 has an operation ridge 581 which extends beyond the slot 571 of the first connection end 54.

Figure 8:
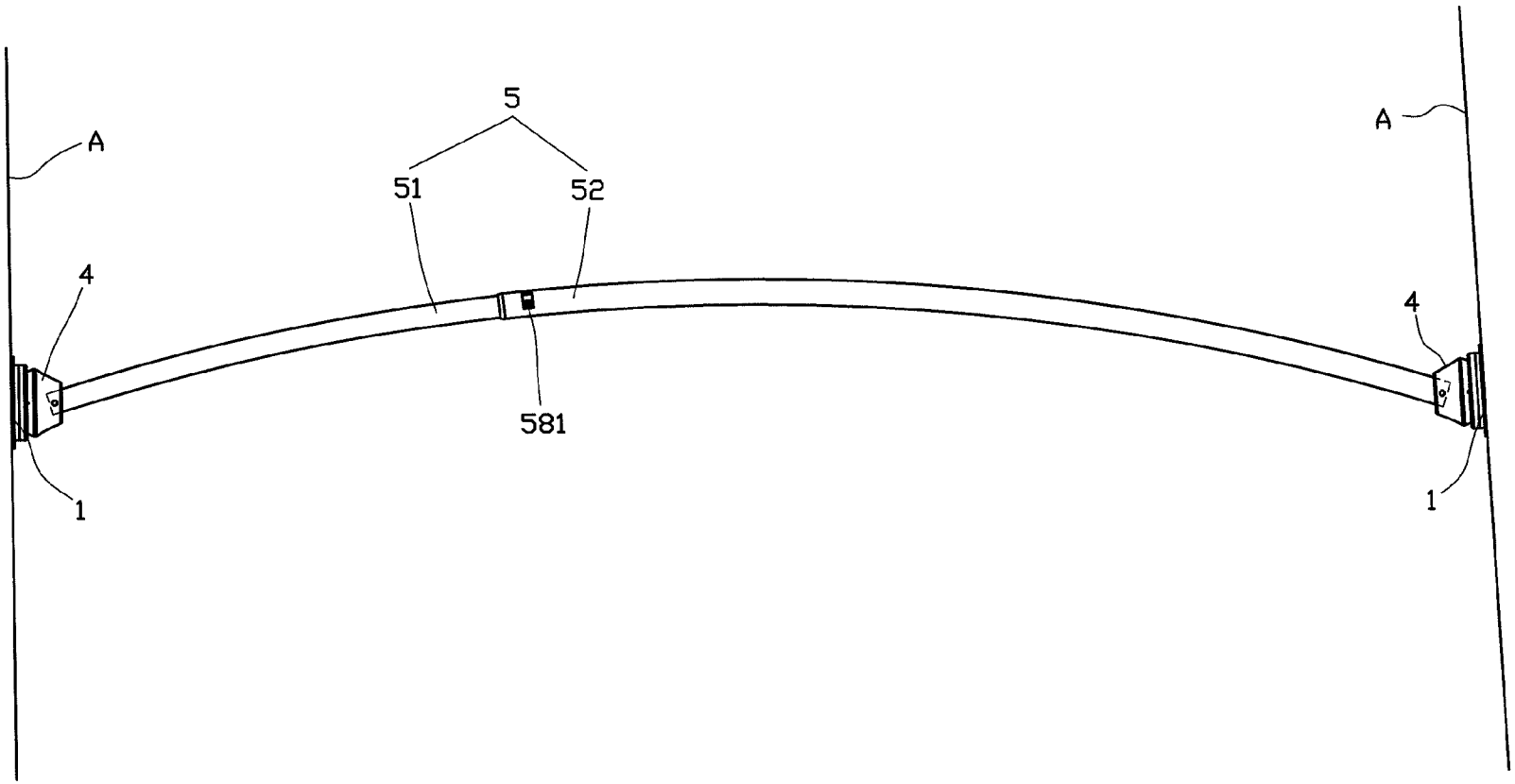
FIG. 8 shows that the shower curtain rod assembly of the present invention is installed between two walls which are not parallel to each other.
Figure 9:
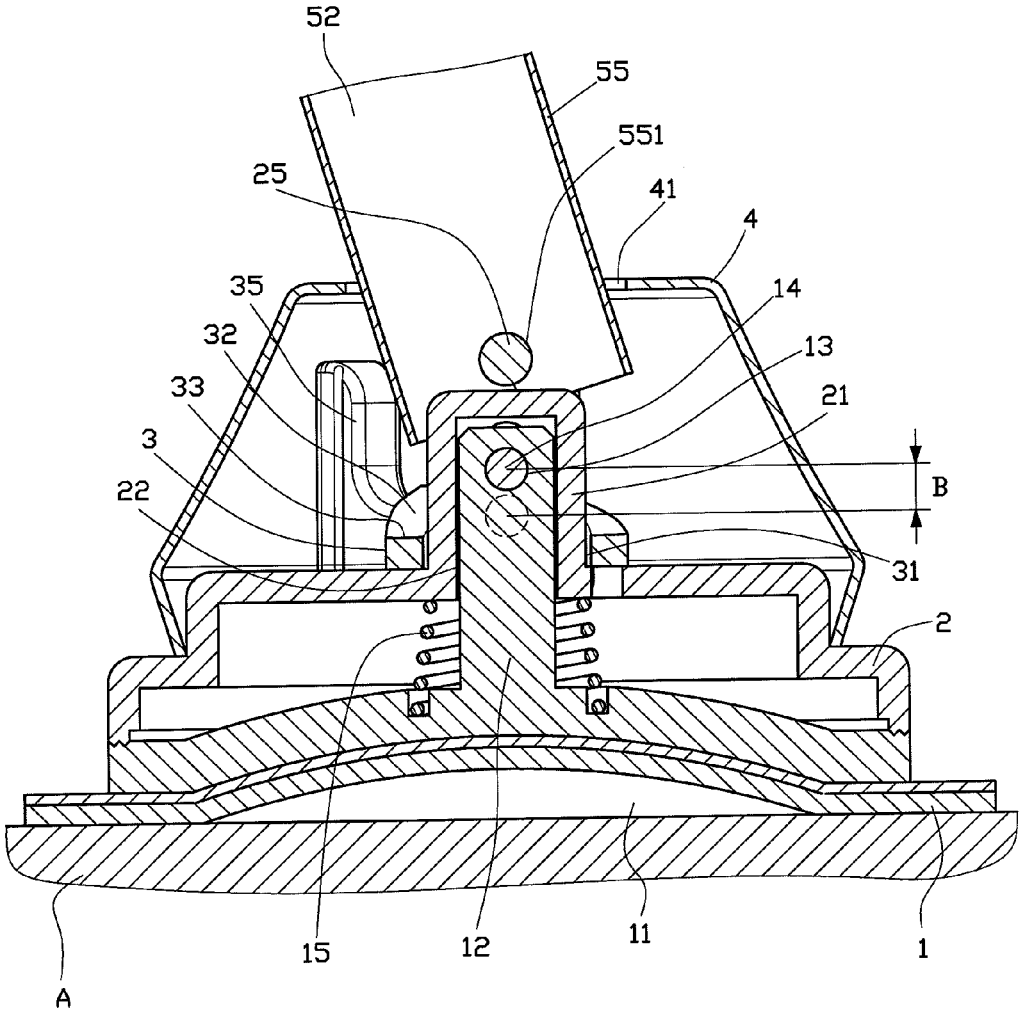
FIG. 9 is a cross sectional view to show that the suction disk is sucked to the wall.
Figure 10:
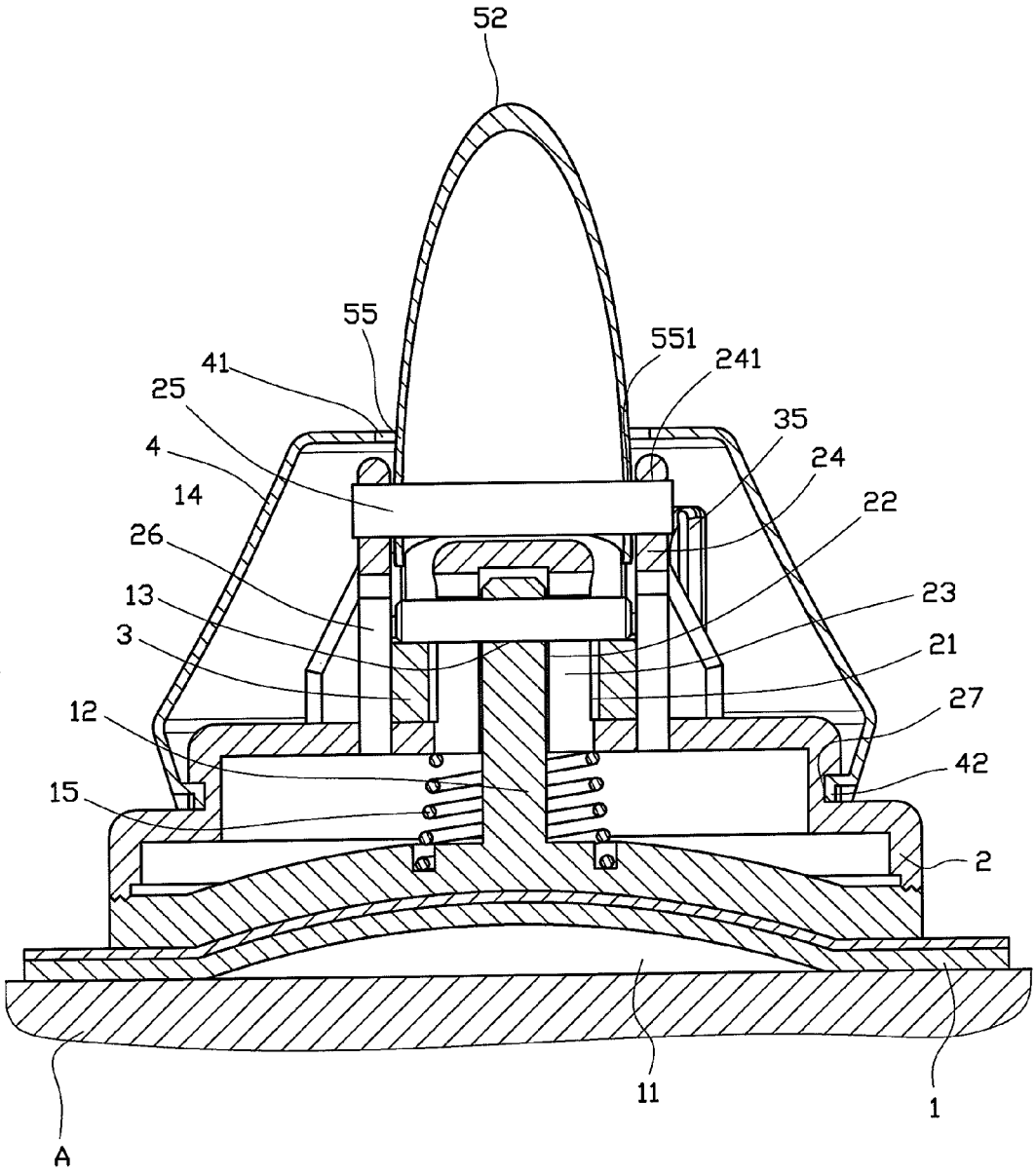
FIG. 10 is another cross sectional view to show that the suction disk is sucked to the wall.

When assembling, as shown in FIGS. 8 to 10, the shower curtain rod assembly is to be installed between two walls (A). The suction surface 11 of the suction disk 1 is sucked on the wall (A) and the blocks 42 are separated from the notches 27 to remove the cover 4 from the engaging member 2. By shifting the levers 35 and rotating the positioning member 3, the protrusion 36 on the underside of the positioning member 3 is movable in the restriction slot 28 of the engaging member 2. When rotating the positioning member 3 relative to the positioning portion 21, the inclined portions 32 of the positioning member 3 are rotated. The second recess 34 on the highest point is moved relative to the pin 14. When the first recess 33 on the lowest point moves to the lower end of the pin 14, the pin 14 moves upward along the inclined portions 32 to generate an axial movement (B) as shown in FIG. 9. Therefore, the engaging member 2 is moved relative to the suction disk 1 to compress the resilient member 15 to move the suction surface 11 toward the wall (A). The air between the suction surface 11 and the wall (A) is pushed away so that the suction surface 11 firmly sucks on the wall (A). The rod unit 5 is installed between the engaging members 2 on the two walls (A). When the two walls (A) are not parallel to each other, the first pivotal end 53 of the first section 51 is rotated an angle relative to the pivotal portion 24 of the engaging member 2. The second pivotal end 55 of the second section 52 is rotated an angle relative to the pivotal portion 24 of the engaging member 2. By rotating the two ends of the rod unit 5 with different angles to connect the rod unit 5 to the two engaging members 2, the shower curtain rod assembly of the present invention can be installed between the two walls (A) of different inclinations.

Figure 11:
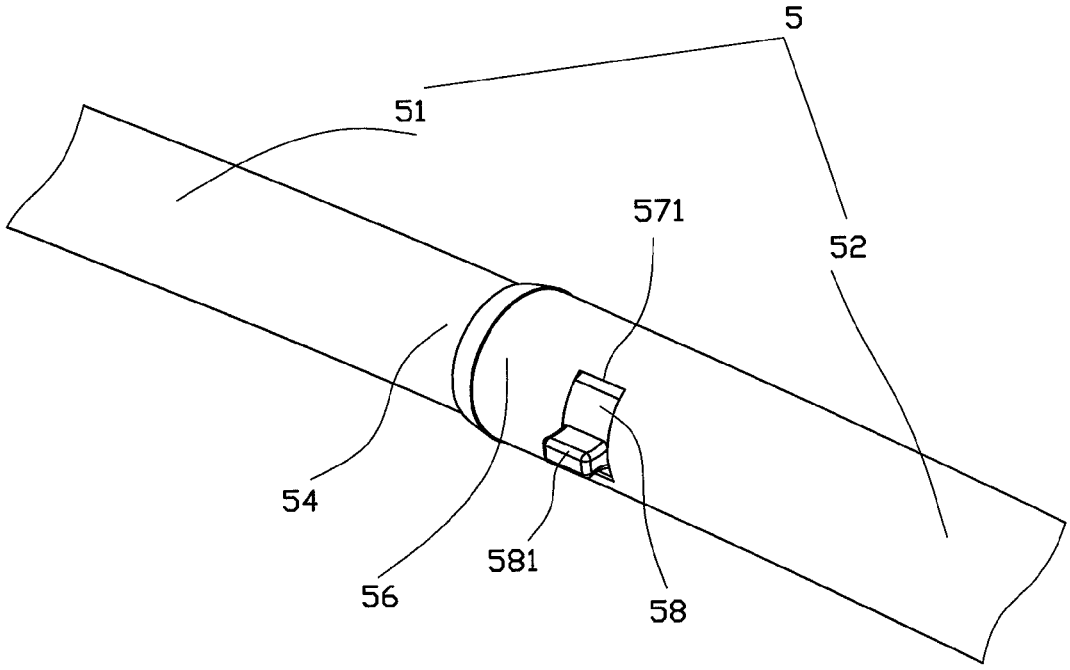
FIG. 11 is a perspective view to show that the contact plate is shifted.
Figure 12:
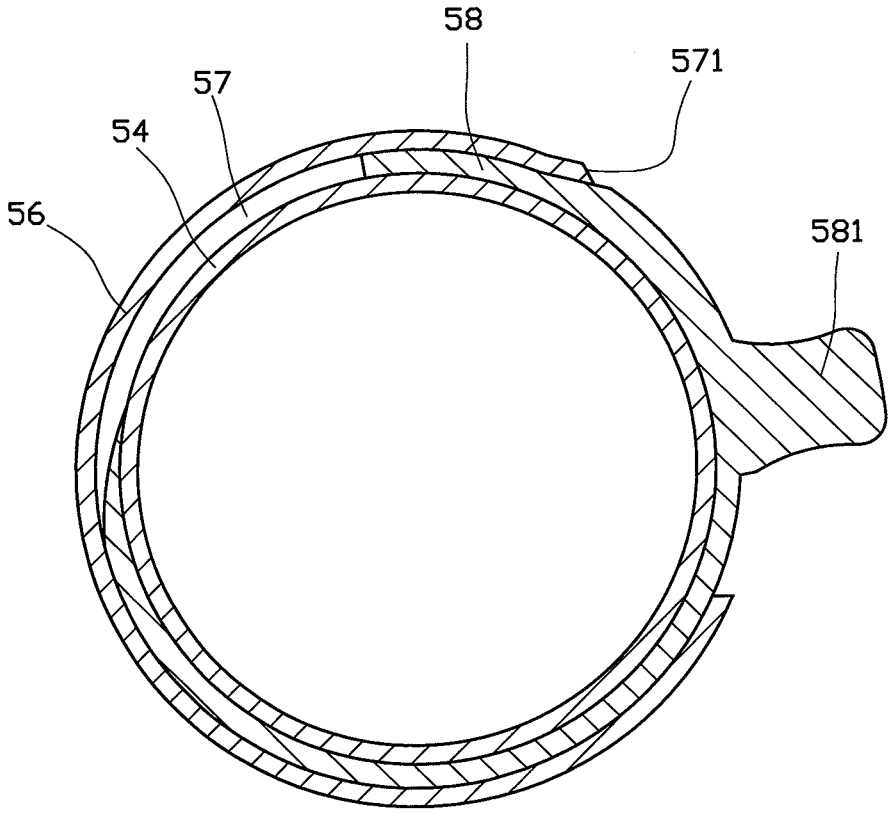
FIG. 12 is a cross sectional view to show that the contact plate is shifted to contact the rod unit.

When adjusting the length of the rod unit 5, the operation ridge 581 can be shifted as shown in FIGS. 7 and 11, to let the contact plate 58 not contact the gap 57 between the first and second sections 51, 52. The first and second sections 51, 52 can be moved relative to each other so as to adjust the rod unit 5 to the desired length. The operation ridge 581 is then shifted again to let the contact plate 58 contact the gap 57 between the first and second sections 51, 52 again as shown in FIG. 12 to set the length of the rod unit 5 to adapt the distance between the two walls (A).

When removing the shower curtain rod assembly from the walls (A), the blocks 42 are disengaged from the notches 27 to remove the cover 4 from the engaging member 2, and the levers 35 are rotated to rotate the positioning member 3. The protrusion 36 at the underside of the positioning member 3 is moved in the restriction slot 28. The positioning member 3 is rotated relative to the positioning portion 21, and the inclined portions 32 of the positioning member 3 are rotated. The first recess 33 on the lowest point of the inclined portions 32 is disengaged from the pin 14 so that the second recess 34 on the highest point of the inclined portions 32 is moved to the lower end of the pin 14. The pin 14 is moved along the inclined portions 32 to generate an axial movement (B) to move back to its initial position as shown in FIG. 9. The resilient member 15 releases its force to let the engaging member 2 not contact the suction surface 11 which then bounces backward and air enters into the space between the suction surface 11 and the wall (A). The suction disk 1 can easily be removed from the wall (A). The shower curtain rod assembly is then ready to be installed to another position.

While we have shown and described the embodiment in accordance with the present invention, it should be clear to those skilled in the art that further embodiments may be made without departing from the scope of the present invention.

What is claimed is:

1. A shower curtain rod assembly comprising:

a suction disk having a suction surface and a push rod connected to the suction disk, the push rod having a hole and a pin extending through the hole, a resilient member mounted to the push rod;

an engaging member connected to the suction disk and having a positioning portion, the positioning portion having a through hole and a first slot, two pivotal portions located on two sides of the positioning portion and each pivotal portion having a hole, a pivot extending through the holes of the pivotal portions, the pivotal portions each having a second slot which is located corresponding to the first slot, a restriction slot defined in the engaging member;

a positioning member located on the engaging member and having a passage, two inclined portions located at a periphery of the passage and each inclined portion having a lowest point and a highest point, a first recess defined in each of the lowest points and a second recess defined in each of the highest points, a lever located on a periphery of the positioning member, a protrusion extending from an underside of the positioning member and extending through the restriction slot;

a cover mounted to the engaging member and having an opening, and a rod unit having a first section and a second section, the first and second sections being movable relative to each other, the first section having a first pivotal end and a first connection end respectively on two ends thereof, the first pivotal end pivotably connected to the pivotal portion of the engaging member, the second section having a second pivotal end and a second connection end respectively on two ends thereof, the second pivotal end pivotably connected to the pivotal portion of the engaging member, a diameter of the second connection end being larger than that of the first connection end, a gap defined between the first and second connection ends when the second connection end is mounted to the first connection end, a slot defined in the first connection end and a contact plate located in the gap, the contact plate having uneven thickness which includes a maximum thickness which is equal to a width of the gap.

2. The shower curtain rod assembly as claimed in claim 1, wherein the engaging member has two notches defined in a periphery thereof and the cover has two blocks on a periphery thereof, the blocks are engaged with the two notches.

3. The shower curtain rod assembly as claimed in claim 1, wherein the inclined portions are located to form a V shape arrangement.

4. The shower curtain rod assembly as claimed in claim 1, wherein the first recess is located at a mediate portion of each of the inclined portions and the second recess is located at a connection portion between the two inclined portions.

5. The shower curtain rod assembly as claimed in claim 4, wherein first pivotal end has a first pivotal hole, the first pivotal end extends into the opening of the cover, the first pivotal end is pivotably connected to the first pivotal hole and the hole of one of the pivotal members by the pivot, the second pivotal end has a second pivotal hole, the second pivotal end extends into the opening of the cover, the second pivotal end is pivotably connected to the second pivotal hole and the hole of the other one of the pivotal members by the pivot.

6. The shower curtain rod assembly as claimed in claim 1, wherein the contact plate has an operation ridge which extends beyond the slot of the first connection end.

7. The shower curtain rod assembly as claimed in claim 1, wherein the restriction slot is a curved slot.

* * * * *